US009354587B2

(12) United States Patent
Ikeda et al.

(10) Patent No.: US 9,354,587 B2
(45) Date of Patent: May 31, 2016

(54) IMAGE FORMING APPARATUS WITH CLEANING UNIT

(71) Applicant: CANON KABUSHIKI KAISHA, Tokyo (JP)

(72) Inventors: Takahiro Ikeda, Saitama (JP); Yuta Isobe, Kawasaki (JP); Shunsuke Mizukoshi, Yokohama (JP); Shuichi Tetsuno, Kawasaki (JP); Ryosuke Kanai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/911,385

(22) Filed: Jun. 6, 2013

(65) Prior Publication Data

US 2013/0336670 A1 Dec. 19, 2013

(30) Foreign Application Priority Data

Jun. 13, 2012 (JP) ..... 2012-133721
Aug. 17, 2012 (JP) ..... 2012-181106
Jun. 4, 2013 (JP) ..... 2013-118051

(51) Int. Cl.
*G03G 15/16* (2006.01)
*G03G 21/00* (2006.01)
*G03G 15/01* (2006.01)

(52) U.S. Cl.
CPC ..... *G03G 21/0005* (2013.01); *G03G 15/0189* (2013.01); *G03G 15/161* (2013.01); *G03G 21/0011* (2013.01)

(58) Field of Classification Search
CPC ..... G03G 21/0005
See application file for complete search history.

(56) References Cited

U.S. PATENT DOCUMENTS 5,253,022 A * 10/1993 Takeuchi et al. ..... 399/313
5,420,668 A * 5/1995 Okano ..... 399/21
5,621,509 A * 4/1997 Karashima et al. ..... 399/46
5,729,788 A * 3/1998 Hirohashi et al. ..... 399/66
6,173,135 B1 * 1/2001 Yuminamochi et al. ..... 399/66
6,321,059 B1 * 11/2001 Tamura ..... 399/297
6,941,085 B2 * 9/2005 Nakano et al. ..... 399/66
7,395,004 B2 * 7/2008 Nishikawa ..... G03G 15/0131 399/101

(Continued)

FOREIGN PATENT DOCUMENTS

JP 4-163560 A 6/1992
JP 2005-165218 A 6/2005

(Continued)

*Primary Examiner* — Billy Lactaoen
*Assistant Examiner* — Arlene Heredia Ocasio
(74) *Attorney, Agent, or Firm* — Fitzpatrick, Cella, Harper & Scinto

(57) ABSTRACT

An image forming apparatus, including: a rotatable image bearing member; a developing unit configured to supply a developer onto the image bearing member; a transfer unit configured to transfer the developer on the image bearing member to a recording medium by a transfer voltage being applied to the transfer unit by a voltage applying unit; and a cleaning unit configured to remove the developer on the image bearing member, wherein when the apparatus stops an image forming operation halfway, the apparatus executes a recovery operation in which the image bearing member is rotated while the voltage applying unit applies a voltage to the transfer unit so that a part of the developer remaining on the image bearing member is once transferred from the image bearing member to the transfer unit, transferred again from the transfer unit to the image bearing member, and then removed by the cleaning unit.

15 Claims, 8 Drawing Sheets

(56) References Cited

U.S. PATENT DOCUMENTS

| | | | | |
|---|---|---|---|---|
| 7,496,306 | B2 * | 2/2009 | Izumi et al. | 399/66 |
| 7,751,738 | B2 * | 7/2010 | Horiuchi et al. | 399/66 |
| 8,472,853 | B2 | 6/2013 | Akamatsu et al. | |
| 8,532,551 | B2 | 9/2013 | Tetsuno et al. | |
| 2002/0141771 | A1 * | 10/2002 | Nishimura | 399/50 |
| 2002/0176716 | A1 * | 11/2002 | Yokoi | 399/21 |
| 2007/0242968 | A1 * | 10/2007 | Chiba | 399/66 |
| 2011/0233813 | A1 | 9/2011 | Ikeda et al. | |
| 2012/0008970 | A1 * | 1/2012 | Takenaka | 399/66 |
| 2012/0189331 | A1 * | 7/2012 | Holden et al. | 399/46 |
| 2013/0129370 | A1 * | 5/2013 | Nakamura et al. | 399/71 |
| 2014/0050499 | A1 * | 2/2014 | Tetsuno | G03G 15/161 399/71 |
| 2014/0294414 | A1 * | 10/2014 | Minato | 399/66 |

FOREIGN PATENT DOCUMENTS

| | | | |
|---|---|---|---|
| JP | 2006350161 | A * | 12/2006 |
| JP | 2010026198 | A * | 2/2010 |
| JP | 2011027849 | A * | 2/2011 |
| JP | 2012063497 | A * | 3/2012 |
| JP | 2012123251 | A * | 6/2012 |

* cited by examiner

IMAGE FORMING APPARATUS WITH CLEANING UNIT

BACKGROUND OF THE INVENTION

1. Field of the Invention

The present invention relates to an image forming apparatus.

2. Description of the Related Art

An image forming apparatus such as a laser beam printer includes a photosensitive drum as an image bearing member, a transfer roller as a transfer unit, and a cleaning blade as a cleaning unit. At the time of performing an image forming operation, a predetermined transfer voltage is applied to the transfer roller in order to transfer a toner as a developer on the photosensitive drum to a recording medium such as paper.

There is known such a configuration that, when the image forming operation is stopped halfway due to a generation of a paper jam or the like, a recovery operation is performed before resuming the image forming operation, to thereby remove the toner remaining on the photosensitive drum without being transferred to the recording medium. The removal of the toner remaining without being transferred is performed by conveying the toner adhered on the photosensitive drum to the cleaning blade along with rotation of the photosensitive drum. At this time, if a voltage having the same polarity as that of the voltage applied in the image forming operation is applied to the transfer roller, the toner on the photosensitive drum is transferred to the transfer roller, and contaminates the transfer roller. Thus, an image defect may occur in the next image formation.

To cope with this problem, Japanese Patent Application Laid-Open No. H04-163560 discloses a configuration for suppressing contamination of the transfer roller due to transfer of the toner on the photosensitive drum to the transfer roller by applying, in the recovery operation, a voltage having a polarity opposite to that of the voltage applied in the image forming operation to the transfer roller.

However, with the method disclosed in Japanese Patent Application Laid-Open No. H04-163560, when the recovery operation is performed in response to the stop of the image forming operation occurring in a state in which a large amount of toner is adhered to the photosensitive drum, a large amount of toner is conveyed to the cleaning blade, and hence the toner may not be completely removed by the cleaning blade. In such a case, the toner that cannot be completely removed and slips through the cleaning blade is adhered to the charging roller, causing a charging failure, which may generate a defective image such as a streaky image. In addition, the toner that has slipped through the cleaning blade may be printed in the next image formation after the recovery operation, causing an image defect such as a streak on an image.

SUMMARY OF THE INVENTION

The present invention has been made to suppress an image defect due to a failure in removing a developer by a cleaning unit.

According to an exemplary embodiment of the present invention, there is provided an image forming apparatus, including: an image bearing member provided in a rotatable manner; a developing unit configured to supply a developer onto the image bearing member; a transfer unit provided downstream of the developing unit in a rotation direction of the image bearing member, and configured to transfer the developer on the image bearing member to a recording medium by a transfer voltage applied to the transfer unit; a voltage applying unit configured to apply the transfer voltage to the transfer unit; and a cleaning unit configured to remove the developer on the image bearing member, wherein when the image forming apparatus stops an image forming operation halfway, the image forming apparatus executes a recovery operation of rotating the image bearing member to cause the cleaning unit to remove the developer remaining on the image bearing member without being transferred to the recording medium, and when the image forming apparatus executes the recovery operation, the voltage applying unit applies a voltage to the transfer unit so that a part of the developer remaining on the image bearing member without being transferred to the recording medium is once transferred from the image bearing member to the transfer unit, transferred again from the transfer unit to the image bearing member, and then removed by the cleaning unit.

According to another exemplary embodiment of the present invention, there is provided an image forming apparatus, including: an image bearing member provided in a rotatable manner; a developing unit configured to supply a developer onto the image bearing member; a transfer unit configured to transfer the developer by a transfer voltage applied to the transfer unit; a voltage applying unit configured to apply the transfer voltage to the transfer unit; and a cleaning unit configured to remove the developer on the image bearing member, wherein when the image forming apparatus stops an image forming operation halfway, the image forming apparatus executes a recovery operation of rotating the image bearing member to cause the cleaning unit to remove the developer remaining on the image bearing member without being transferred to a recording medium, and when the image forming apparatus executes the recovery operation, the voltage applying unit applies a voltage to the transfer unit so that a part of the developer remaining on the image bearing member without being transferred to the recording medium is once transferred from the image bearing member to a collecting unit, and a part of the developer transferred to the collecting unit is transferred to the image bearing member and then removed by the cleaning unit.

Further features of the present invention will become apparent from the following description of exemplary embodiments with reference to the attached drawings.

DESCRIPTION OF THE EMBODIMENTS

Overall Configuration of Image Forming Apparatus

Figure 1:
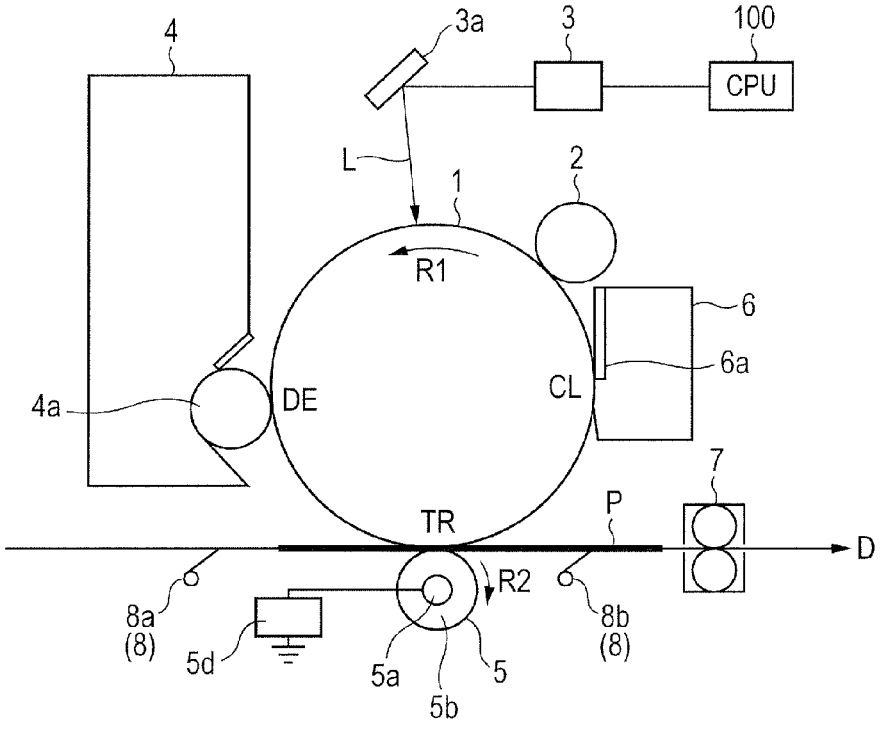
FIG. 1 is a schematic cross-sectional view illustrating an overall configuration of an image forming apparatus according to an embodiment of the present invention.

An overall configuration of an image forming apparatus according to an exemplary embodiment of the present invention will be described with reference to FIG. 1. FIG. 1 is a schematic cross-sectional view illustrating the overall configuration of the image forming apparatus. In FIG. 1, a laser beam printer will be described as an example of the image forming apparatus. However, the image forming apparatus is not limited to this, but can be a copying machine, a light emitting diode (LED) printer, a word processor, a facsimile apparatus, or a multifunction peripheral having multiple functions of such apparatus. The image forming apparatus according to this embodiment includes, as main components, a photosensitive drum 1 as an image bearing member, a charging roller 2, an exposing device 3, a developing device 4, a transfer roller 5 as a transfer unit, and a cleaning device 6. The photosensitive drum 1 and the developing device 4 may be integrally formed into a cartridge which may be removably mountable to an image forming apparatus main body or installed in the image forming apparatus.

The photosensitive drum 1 is rotatably provided to receive a driving force at the time of performing an image forming operation and to rotate in a direction indicated by an arrow R1 in FIG. 1 at a predetermined process speed (rotation speed). In a first embodiment of the present invention, a diameter of the photosensitive drum 1 is 24 mm and the rotation speed is 100 mm/sec.

The charging roller 2 is provided so as to abut against the photosensitive drum 1 and uniformly charges a surface of the photosensitive drum 1. The charging roller is arranged upstream of the developing device 4 in a rotation direction of the photosensitive drum 1. The exposing device 3 emits a laser beam L to expose the surface of the photosensitive drum 1 via a reflection mirror 3*a*.

The developing device 4 includes a developing roller 4*a* as a developing unit, which is rotatably provided. The developing roller 4*a* carries a toner as a developer on its surface, and supplies the toner to the photosensitive drum 1. In this embodiment, a magnetic one-component toner having a negative charging property is used as the toner.

The transfer roller 5 abuts against the photosensitive drum 1 so as to be rotatable in a direction indicated by an arrow R2 in FIG. 1. The transfer roller 5 nips and conveys a recording medium (sheet material) P as a transfer material with the photosensitive drum 1, and at this time, transfers the toner on the photosensitive drum 1 (image bearing member) to the recording medium P. The transfer roller 5 is provided downstream of the developing device 4 in the rotation direction of the photosensitive drum 1. In this embodiment, the transfer roller 5 includes an electrically-conductive core metal 5*a* having a diameter of 5 mm and a urethane foamed layer 5*b*, and a diameter of the transfer roller 5 is 13 mm. The image forming apparatus according to this embodiment further includes a bias applying unit 5*d* as a voltage applying unit which applies a voltage to the transfer roller 5. At the time of performing an image forming operation, a transfer voltage (transfer bias) V0 is applied to the transfer roller 5 by the bias applying unit 5*d*.

The cleaning device 6 includes a cleaning blade 6*a* as a cleaning unit in contact with the photosensitive drum 1. At the time of performing an image forming operation, the cleaning blade 6*a* scrapes the toner remaining on the photosensitive drum 1 after the toner is transferred to the recording medium P by the transfer roller 5 to remove the toner from the photosensitive drum 1. The cleaning blade 6*a* is arranged downstream of the transfer roller 5 in the rotation direction of the photosensitive drum 1.

Image Forming Operation

An overall image forming operation of the image forming apparatus will be described below with reference to FIG. 1. Firstly, the charging roller 2 uniformly charges the surface of the photosensitive drum 1. The exposing device 3 then exposes with the laser beam L the surface of the photosensitive drum 1 which is uniformly charged, to thereby form an electrostatic latent image on the photosensitive drum 1. The developing roller 4*a* supplies the toner to the photosensitive drum 1 (a position where the toner is supplied is hereinafter referred to as "developing position DE"), to thereby visualize the electrostatic latent image. Thus, a toner image (developer image) is formed on the photosensitive drum 1. The toner image formed on the photosensitive drum 1 is conveyed to a position where the photosensitive drum 1 and the transfer roller 5 abut against each other (hereinafter referred to as "transfer position TR") through rotation of the photosensitive drum 1. On the other hand, the recording medium P stored in a feed cassette (not shown) included in the image forming apparatus is conveyed to the transfer position TR. The toner image is transferred to the recording medium P at the transfer position TR. After the toner image is transferred, the toner remaining on the photosensitive drum 1 is conveyed to a position where the photosensitive drum 1 and the cleaning blade 6*a* abut against each other (hereinafter referred to as "cleaning position CL") through the rotation of the photosensitive drum 1, and removed by the cleaning blade 6*a*. The toner image transferred to the recording medium P is pressurized and heated by a fixing device 7, and fixed on the recording medium P. After that, the recording medium P on which the toner image is fixed is conveyed to the outside of the image forming apparatus, and hence a sequence of the image forming operation is completed.

Detection of Stop of Image Forming Operation

Detection of a stop of the image forming operation will be described below with reference to FIG. 1. A case where the image forming operation is stopped includes, for example, a case where the image forming operation is brought to an emergency stop due to generation of a paper jam or opening of a door of the main body by a user in the image forming operation.

The image forming apparatus illustrated in FIG. 1 includes a registration sensor 8*a* and a sheet discharge sensor 8*b* as a stop detecting unit 8. As illustrated in FIG. 1, the registration sensor 8*a* is provided upstream of the transfer position TR in a conveying direction D of the recording medium P, and the sheet discharge sensor 8*b* is provided on downstream of the transfer position TR and upstream of the fixing device 7 in the conveying direction D.

The registration sensor 8*a* is a sensor which is configured to match the timing at which the recording medium P is conveyed to the transfer position TR and the timing at which the toner image formed on the photosensitive drum 1 is conveyed to the transfer position TR. The sheet discharge sensor 8*b* is a sensor which is configured to confirm whether or not the recording medium P is discharged to the outside of the image forming apparatus.

When the sheet discharge sensor 8*b* does not detect the recording medium P until a predetermined time is elapsed after the registration sensor 8*a* detects the recording medium P, it is detected that the image forming operation is stopped because there is a paper jam between the registration sensor 8*a* and the sheet discharge sensor 8*b*. Further, when the sheet discharge sensor 8*b* is not turned OFF until a predetermined time is elapsed after the sheet discharge sensor 8*b* detects the recording medium P (i.e., the recording medium P is continuously detected), it is detected that the image forming operation is stopped because there is a paper jam in the fixing device 7. In both the cases of detection, information of the sensor is processed in a controller unit 100 (see FIG. 1) included in the image forming apparatus, and the user is informed that the image forming operation is stopped.

Flow After Stop of Image Forming Operation

Figure 2:
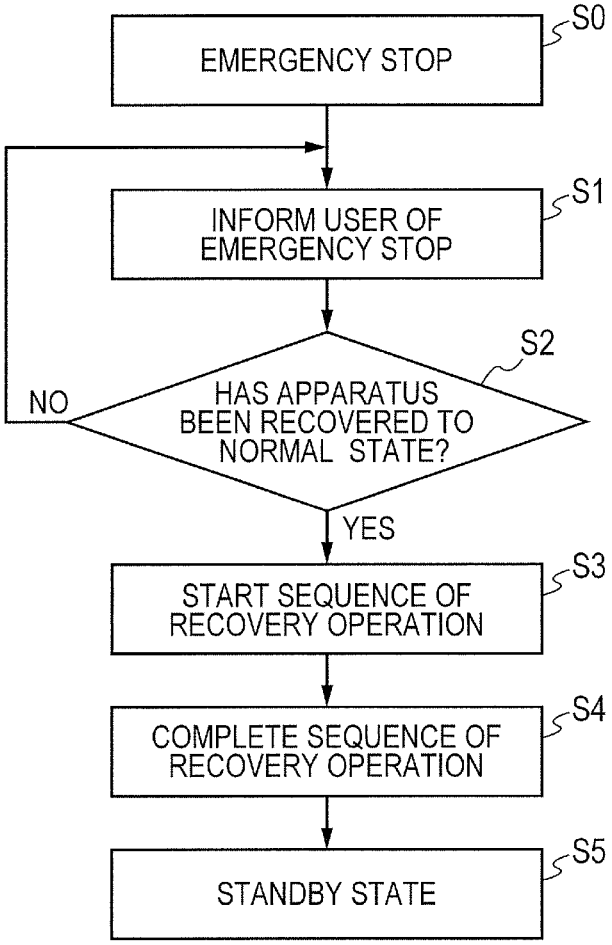
FIG. 2 is a flowchart illustrating a sequence after an emergency stop according to the embodiment of the present invention.

A flow up to transition to a standby state by performing a recovery operation after the image forming operation is stopped will be described below with reference to FIG. 2. FIG. 2 is a flowchart illustrating a sequence after the stop of the image forming operation is detected. When an emergency stop of the image forming operation due to a paper jam or the opening of the door of the main body is detected (Step S0), the user is informed of the stop of the image forming operation (Step S1). At this time, the user can clear the paper jam by removing the jammed sheet. After that, the controller unit (CPU) 100 included in the image forming apparatus determines whether or not the image forming apparatus is recovered to a normal state (Step S2). When it is determined that the image forming apparatus is not recovered to the normal state (NO in Step S2), the user is again informed of the stop of the image forming operation (Step S1). When it is determined that the image forming apparatus is recovered to the normal state (YES in Step S2), a sequence of the recovery operation is started (Step S3). After the sequence of the recovery operation is completed (Step S4), the image forming operation makes a transition to the standby state in which the image forming operation can be resumed (Step S5).

Sequence After Detection of Paper Jam

Figure 3:
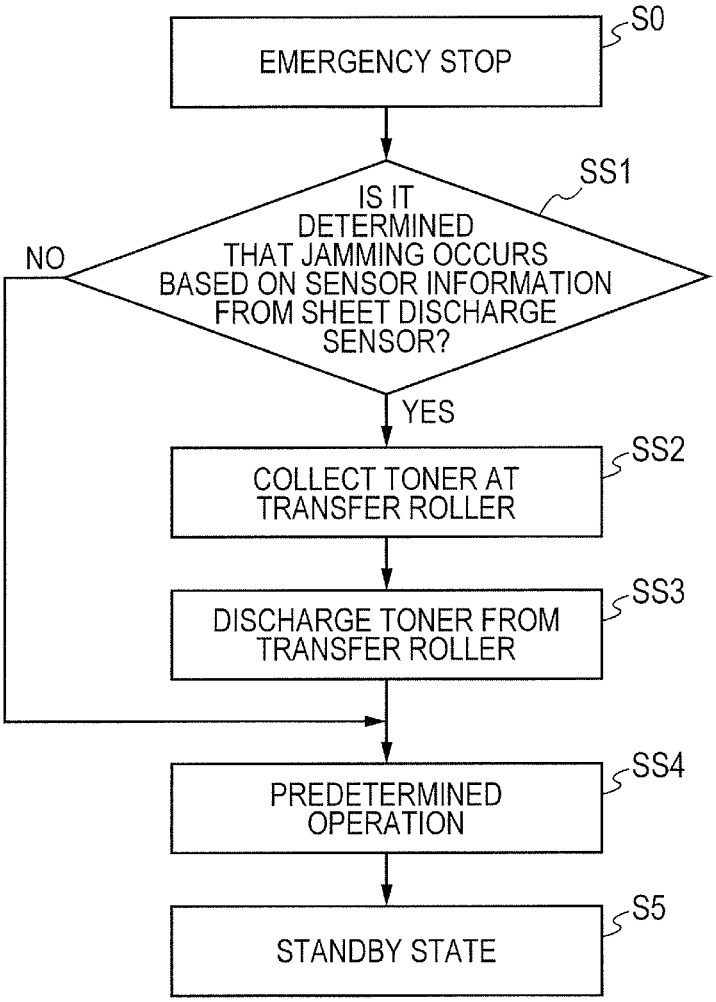
FIG. 3 is a flowchart illustrating a sequence after detecting a paper jam according to the embodiment of the present invention.

A sequence after detecting a paper jam will be described below with reference to FIG. 3. FIG. 3 is a flowchart illustrating a sequence after detecting a paper jam according to this embodiment. When the image forming operation is stopped in a state in which the paper jam or the like occurs so that the toner remains on the photosensitive drum 1 without being transferred, the toner adhered on the photosensitive drum 1 first needs to be removed by executing the recovery operation before resuming the image forming operation. At this time, the toner remaining on the photosensitive drum 1 without being transferred is removed by conveying the toner to the cleaning blade 6*a* through rotation of the photosensitive drum 1. The image forming apparatus according to this embodiment further includes a stop unit which is configured to stop the image forming operation halfway when a paper jam or the like occurs.

The image forming apparatus according to this embodiment is configured to convey the toner, which remains on the photosensitive drum 1 without being transferred, to the cleaning blade 6*a* multiple times when executing the recovery operation. When a large amount of toner is conveyed at a time to the cleaning blade 6*a*, the cleaning blade 6*a* may not completely remove the toner. That is, the image forming apparatus according to this embodiment is configured to suppress incomplete removal of the toner by the cleaning blade 6*a* and consequent slip-through of the toner. The sequence according to this embodiment is useful when the toner exists on the photosensitive drum 1 at the time when the paper jam is detected.

As illustrated in FIG. 3, first, when the image forming operation is brought to an emergency stop (Step S0), the controller unit 100 determines whether or not there is a paper jam based on the sensor information from the sheet discharge sensor 8*b* (Step SS1). When it is determined that there is a paper jam (YES in Step SS1), a voltage of a positive polarity, which is the same polarity as that of the applied voltage in the image forming operation, is applied to the transfer roller 5 by the voltage applying unit. With the application of the voltage of the positive polarity, a part of the toner adhered on the photosensitive drum 1 is once transferred and collected from the photosensitive drum 1 to the transfer roller 5 (Step SS2). At this time, the toner which is not transferred to the transfer roller 5 is conveyed to the cleaning blade 6*a* and removed by the cleaning blade 6*a*. After that, a voltage of a negative polarity, which is a polarity opposite to that of the applied voltage in the image forming operation, is applied to the transfer roller 5 by the voltage applying unit. With the application of the voltage of the negative polarity, the toner transferred to the transfer roller 5 is discharged from the transfer roller 5 to be transferred again to the photosensitive drum 1 (Step SS3). The toner transferred to the photosensitive drum 1 is then conveyed to the cleaning blade 6*a* through the rotation of the photosensitive drum 1 and removed by the cleaning blade 6*a*. After that, a predetermined operation to make a transition to the standby state is performed in the image forming apparatus (Step SS4), to thereby place the image forming apparatus in the standby state for performing the normal image forming operation (Step S5). On the other hand, when there is an emergency stop of the image forming operation (Step S0), and when it is determined that there is no paper jam (NO in Step SS1), a predetermined operation to make a transition to the standby state is then performed (Step SS4), to thereby put the image forming apparatus into the standby state in order to perform the normal image forming operation (Step S5).

Voltage Application Timing 1

Figure 4:
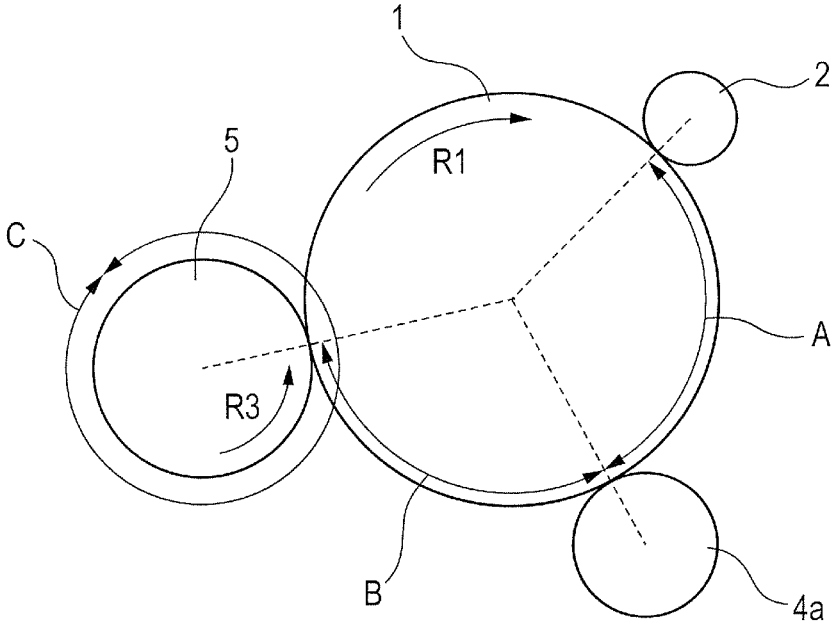
FIG. 4 is a diagram illustrating an arrangement of a photosensitive drum, a charging roller, a developing roller, and a transfer roller.
Figure 5:
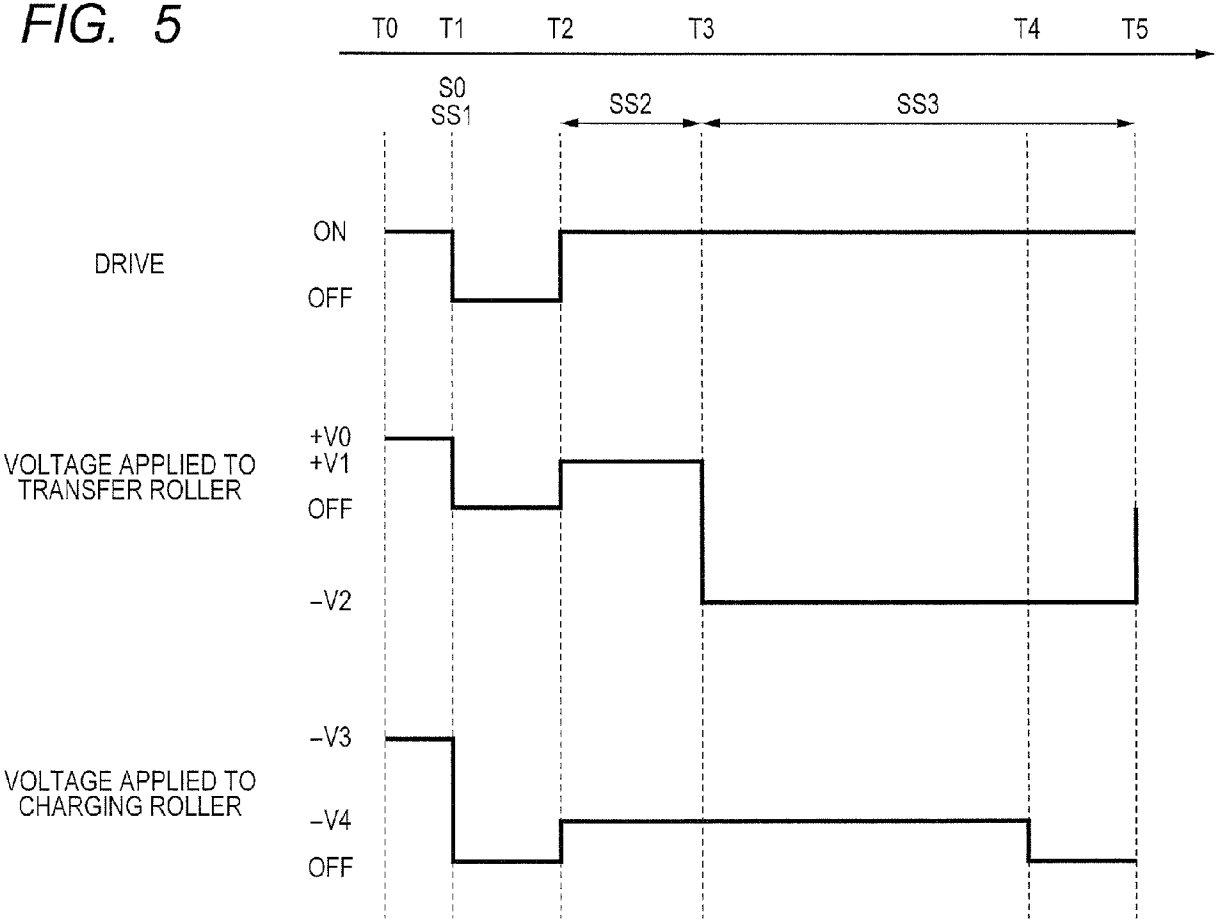
FIG. 5 is a timing chart illustrating timings for applying voltages to the transfer roller and the charging roller.

Timings for applying the voltages to the transfer roller 5 and the charging roller 2 according to this embodiment will be described below with reference to FIGS. 4 and 5. FIG. 4 is a diagram illustrating an arrangement of the photosensitive drum 1, the charging roller 2, the developing roller 4*a*, and the transfer roller 5. FIG. 5 is a timing chart illustrating the voltage application timings.

As illustrated in FIG. 4, a distance in a circumferential direction of the photosensitive drum 1 between a position of the surface of the photosensitive drum 1, which abuts against the charging roller 2, and a position of the surface of the photosensitive drum 1, to which the toner is supplied by the developing roller 4*a*, is defined as a distance A. A distance in the circumferential direction of the photosensitive drum 1 between the position of the surface of the photosensitive drum 1, to which the toner is supplied by the developing roller 4*a*, and an abutment position of the photosensitive drum 1 and the transfer roller 5 is defined as a distance B. Further, as illustrated in FIG. 4, a circumferential length of the transfer roller 5 is defined as a circumferential length C. A region of the surface of the photosensitive drum 1 in the circumferential direction of the photosensitive drum 1 between the position of the surface of the photosensitive drum 1, which abuts against the charging roller 2, and the position of the surface of the photosensitive drum 1, to which the toner is supplied by the developing roller 4*a*, is hereinafter defined as a region A. Further, a region of the surface of the photosensitive drum 1 in the circumferential direction of the photosensitive drum 1 between the position of the surface of the photosensitive drum 1, to which the toner is supplied by the developing roller 4*a*, and the abutment position of the photosensitive drum 1 and the transfer roller 5 is defined as a region B.

"V0" in FIG. 5 indicates a magnitude of the transfer voltage applied to the transfer roller 5 at the time of performing an image forming operation. "V1" indicates a magnitude of the voltage applied to the transfer roller 5 by the voltage applying unit when transferring and collecting the toner on the photosensitive drum 1 to the transfer roller 5. The voltage V1 is a voltage for transferring to the transfer roller 5 a part of the toner remaining on the photosensitive drum 1 without being transferred, and hence the voltage V1 is smaller than the transfer voltage V0. Further, the voltage V1 is a voltage having the same polarity as that of the transfer voltage and a potential difference from the transfer voltage larger than zero. "V2" indicates a magnitude of the voltage applied to the transfer roller 5 by the voltage applying unit when transferring the toner transferred to the transfer roller 5 again to the photosensitive drum 1. "V3" indicates a magnitude of the voltage applied to the charging roller 2 at the time of performing the image forming operation. "V4" indicates a magnitude of the voltage applied to the charging roller 2 when transferring and collecting the toner on the photosensitive drum 1 to the transfer roller 5. The reason why the voltage V4, which is larger than the voltage V3, is applied to the charging roller 2 is to adjust a surface potential of the photosensitive drum 1 so that the toner is stably transferred from the transfer roller 5 to the photosensitive drum 1 (V3≤V4).

"T0" in FIG. 5 indicates a time at which a transfer voltage +V0 is applied to the transfer roller 5 and a charging voltage −V3 is applied to the charging roller 2 in the image forming operation. "T1" indicates a timing at which a paper jam is detected so that the image forming operation is brought to an emergency stop. That is, the timing T1 indicates the timing of Step S0 illustrated in FIG. 2 and Step SS1 illustrated in FIG. 3. "T2" indicates a timing at which execution of the recovery operation is started from the state of the emergency stop. That is, the timing T2 indicates a start timing of Step SS2 illustrated in FIG. 3. "T3" indicates a timing at which a sequence of transferring and collecting the toner on the photosensitive drum 1 to the transfer roller 5 is completed. That is, the timing T3 indicates a start timing of Step SS3 illustrated in FIG. 3. It can also be said that the timing T3 is a timing at which the region B on the photosensitive drum 1 illustrated in FIG. 4 passes through the abutment position between the transfer roller 5 and the photosensitive drum 1.

"T4" indicates a timing for ending the application of a voltage −V4 to the charging roller 2 to adjust the potential on the photosensitive drum 1 during a discharge process to transfer the toner transferred to the transfer roller 5 again to the photosensitive drum 1. "T5" indicates a timing for ending the discharge process to transfer the toner transferred to the transfer roller 5 again to the photosensitive drum 1. That is, the timing T5 indicates a timing for ending the process of Step SS3 illustrated in FIG. 3.

As illustrated in FIG. 5, a period from T0 to T1 is a period during which the image forming operation is performed so that rotation drive (hereinafter simply referred to as "drive") of the photosensitive drum 1 and the transfer roller 5 is in an ON state, a voltage +V0 is applied to the transfer roller 5, and a voltage −V3 is applied to the charging roller 2. Further, a period from T1 to T2 is a period during which the image forming operation is brought to an emergency stop due to detection of a paper jam so that the drive, the application of the voltage to the transfer roller 5, and the application of the voltage to the charging roller 2 are in an OFF state.

A period from T2 to T3 is a period during which the drive is in an ON state to recover from the emergency stop so that a voltage +V1 of a positive polarity is applied to the transfer roller 5, and a voltage −V4 is applied to the charging roller 2. A period from T3 to T4 is a period during which a voltage −V2 of a negative polarity is applied to the transfer roller 5, and the voltage −V4 is continued to be applied to the charging roller 2. A period from T4 to T5 is a period during which the voltage −V2 is continued to be applied to the transfer roller 5. On the other hand, the adjustment of the surface potential on the photosensitive drum 1 to transfer the toner from the transfer roller 5 to the photosensitive drum 1 is ended, and hence the application of the voltage to the charging roller 2 is turned OFF. The timing T5 is the timing at which the discharge of the toner from the transfer roller 5 to the photosensitive drum 1 is ended, and hence the application of the voltage to the transfer roller 5 at T5 is turned OFF.

As described above, at the time of executing the recovery operation, during a period in which a portion of the surface of the photosensitive drum 1, to which the developer is supplied by the developing roller when the image forming operation is stopped, is rotated to move away from the developing unit and then first arrives at a position at which the portion comes into contact with the transfer roller 5, the developer is transferred to the transfer roller 5. After that, the developer is transferred from the transfer roller 5 to the photosensitive drum 1, enabling the cleaning to be performed efficiently. Further, at the time when the image forming operation is stopped, a portion of the photosensitive drum 1 located in the region B is configured to transfer a part of the developer to the transfer roller 5 when the portion first arrives at a position at which the portion comes into contact with the transfer roller 5. As a result, the time required until the recovery is completed can be shortened. That is, when the image forming operation is brought to an emergency stop due to a paper jam or the like, a part of the untransferred toner existing in the region B is transferred to the transfer roller 5 immediately after the recovery operation is started, and hence the above-mentioned effect can be achieved.

In FIG. 5, although the timing T3 is set to the timing at which the region B passes through the abutment position with respect to the transfer roller 5, the present invention is not limited to this scheme. For example, by setting the timing T3 to a timing after the region A on the photosensitive drum 1 passes through the abutment position with respect to the transfer roller 5 (timing after a portion of the photosensitive drum 1 which abuts against the charging roller 2 at the time of stoppage arrives at the abutment position with respect to the transfer roller 5), more stable transfer of the toner can be performed. This is for the following reason. In a state in which a paper jam is detected and the image forming operation is stopped, the region A of the photosensitive drum 1 is charged by the charging roller 2 to be the surface potential at the time of performing the image forming operation. However, the potential on the photosensitive drum 1 may be changed and become unstable due to an opening and closing operation of the image forming apparatus main body by a user in a state in which the image forming operation is stopped. Therefore, the toner can be transferred more stably if control for discharging the toner from the transfer roller 5 to the photosensitive drum is performed after a region of the surface of the photosensitive drum 1 where the surface potential is controlled by the charging roller 2 (the region A and the region B) passes through the abutment position. However, in this case, the recovery operation takes more time than in the case where the timing T3 is set to a timing immediately after the region B passes through the abutment position as described above.

In a case where "circumferential length C>distance A+distance B" is satisfied, it is not necessary to consider whether the timing T3 is the timing at which the region B passes through the abutment position between the photosensitive drum 1 and the transfer roller 5 or the timing at which the region A passes through the abutment position as described above. It is because, in the case where "circumferential length C>distance A+distance B" is satisfied, when the toner transferred to the transfer roller 5 is conveyed again to the abutment position through the rotation of the transfer roller 5, the region A always passes through the abutment position by then.

Experimental Results

Experimental results on an amount of the toner on the photosensitive drum 1 and slip of the toner through the cleaning blade 6*a* will be described below. In this experiment, the charging roller 2, the developing roller 4*a*, and the transfer roller 5 were arranged around the photosensitive drum 1 so that the distance A illustrated in FIG. 4 became 18 mm and the distance B illustrated in FIG. 4 became 20 mm. Further, the transfer roller 5 having the circumferential length C of 40 mm was used. That is, "circumferential length C (40 mm)>distance A (18 mm)+distance B (20 mm)" was satisfied so that the toner can be transferred stably from the transfer roller 5 to the photosensitive drum 1 as described above. Further, in this experiment, the toner image was formed on the entire surface of the region B of the surface of the photosensitive drum 1 (solid toner image). The description is given assuming that the amount of the toner on the photosensitive drum 1 in this state is a toner amount of 100%.

Firstly, in this experiment, a relationship between the amount of the toner on the photosensitive drum conveyed to the cleaning blade 6*a* and the slip of the toner through the cleaning blade 6*a* was confirmed. The results of the slip-through obtained at each voltage while changing the voltage applied to the transfer roller 5 from +300 V to +1,500 V are shown in Table 1. In Table 1, a case where the slip-through occurred and caused a risk of an image defect is indicated by "×", a case where slight slip-through was confirmed but did not cause a risk of an image defect is indicated by "Δ", and a case where there was no slip-through is indicated by "○".

TABLE 1

| Voltage applied to transfer roller | +300 V | +600 V | +1,000 V | +1,500 V |
|---|---|---|---|---|
| Amount of toner on photosensitive drum | 75% | 50% | 25% | 5% |
| Slip-through of toner | Δ | ○ | ○ | ○ |

As can be seen from Table 1, when 75% of the toner remained on the photosensitive drum 1 (i.e., 25% of the toner was transferred to the transfer roller 5), the slip-through of the toner occurred. Although the slip-through was not such a high level that an image defect was confirmed, because it is preferred that no slip-through occurs, it can be said that more than 25% of the toner (developer) remaining on the photosensitive drum 1 is preferred to be transferred to the transfer roller 5, where it is assumed that the amount of the toner (developer) remaining on the photosensitive drum 1 is 100%. When 50% of the toner remained on the photosensitive drum 1 (i.e., when 50% of the toner was transferred to the transfer roller 5), there was no slip-through of the toner. That is, in order to prevent the slip-through of the toner, it is preferred that the amount of the toner (developer) remaining on the photosensitive drum 1 and conveyed to the cleaning blade 6*a* be 50% or less. In other words, it is preferred that the amount of the toner of 50% or more be transferred to the transfer roller 5.

Further, a relationship between the slip-through of the toner and the voltage applied to the transfer roller 5 was confirmed. Experiments 1 to 5 are shown in Table 2 in this order from the left. As can be seen from Table 1, it is preferred that the amount of the toner conveyed to the cleaning blade 6*a* without being transferred to the transfer roller 5 be 50% or less, and hence the voltage V1 applied to the transfer roller 5 was set to +1,500 V in Experiments 1 to 4 and +600 V in Experiment 5. In each of the experiments, the surface potential of the photosensitive drum 1 was set to −100 V.

TABLE 2

| | Experiment 1 | Experiment 2 | Experiment 3 | Experiment 4 | Experiment 5 |
|---|---|---|---|---|---|
| Voltage V1 applied to transfer roller | +1,500 V | +1,500 V | +1,500 V | +1,500 V | +600 V |
| Amount of toner on transfer roller in Step SS2 | 95% | 95% | 95% | 95% | 50% |
| Voltage V2 applied to transfer roller | −1,500 V | −1,200 V | −800 V | −500 V | −800 V |
| Surface potential of photosensitive drum | −100 V | −100 V | −100 V | −100 V | −100 V |
| Discharge amount of toner to photosensitive drum in Step SS3 | 90% | 75% | 50% | 25% | 50% |
| Number of revolutions of transfer roller | 2 | 2 | 2 | 4 | 1 |
| Slip-through of toner | Δ | Δ | ○ | ○ | ○ |

Experiment 1 will be described first. In the process of Step SS2 illustrated in FIG. 3, when the voltage V1 was set to +1,500 V, the amount of the toner transferred to the transfer roller 5 was 95%. That is, the amount of the toner conveyed to the cleaning blade 6*a* was 5%, which did not cause any slip-through of the toner. Further, in the process of Step SS3 illustrated in FIG. 3, when the voltage V2 was set to −1,500 V, the amount of the toner transferred to the transfer roller 5 and then transferred from the transfer roller 5 again to the photosensitive drum 1 was 90%. That is, the amount of the toner conveyed to the cleaning blade 6*a* was more than 50%, which caused the slip-through of the toner.

In Experiment 2, the voltage V1 in the process of Step SS2 illustrated in FIG. 3 was set to +1,500 V in the same manner as in Experiment 1, and the voltage V2 in the process of Step SS3 illustrated in FIG. 3 was set to −1,200 V. In this case, the amount of the toner transferred to the transfer roller 5 and then transferred from the transfer roller 5 again to the photosensitive drum 1 was 75%. That is, the amount of the toner conveyed to the cleaning blade 6*a* was more than 50%, which caused the slip-through of the toner.

In Experiments 3 and 4, the voltage V1 in the process of Step SS2 illustrated in FIG. 3 was set to +1,500 V in the same manner as in Experiment 1, and the voltage V2 in the process of Step SS3 illustrated in FIG. 3 was set to −800 V and −500 V, respectively. In this case, the amount of the toner transferred to the transfer roller 5 and then transferred from the transfer roller 5 again to the photosensitive drum 1 was 50% and 25%, respectively. That is, the amount of the toner conveyed to the cleaning blade 6*a* was 50% or less, which did not cause the slip-through of the toner in Experiments 3 and 4.

In Experiment 5, the voltage V1 in the process of Step SS2 illustrated in FIG. 3 was set to +600 V, and the voltage V2 in the process of Step SS3 illustrated in FIG. 3 was set to −800 V. In this case, the amount of the toner transferred to the transfer roller 5 and then transferred from the transfer roller 5 again to the photosensitive drum 1 was 50%. That is, the amount of the toner conveyed to the cleaning blade 6*a* was 50% or less, which did not cause the slip-through of the toner.

From the above-mentioned experimental results, it has been found that the slip-through of the toner at the cleaning blade 6*a* can be prevented from occurring by controlling the voltage applied to the transfer roller 5 to be the values in Experiments 3 to 5. In Experiment 3, the number of revolutions of the transfer roller 5 was two. Thus, all the toner once transferred to the transfer roller 5 was transferred again to the photosensitive drum 1. In Experiments 4 and 5, the numbers of revolutions of the transfer roller 5 were four and one, respectively. Thus, all the toner once transferred to the transfer roller 5 was transferred again to the photosensitive drum 1. That is, it can be said that the image forming apparatus can be recovered from the stopped state most efficiently by performing the control of Experiment 5 in which the photosensitive drum 1 travels the shortest distance. In other words, although it is ideal that all the toner transferred to the transfer roller 5 is conveyed to the cleaning blade 6*a* through one revolution of the rotation of the transfer roller 5, two revolutions or more are still acceptable. For example, when a flexible material is used for the cleaning blade 6*a*, the amount of the toner that can be conveyed at a time is small, and hence it can be considered to suppress the amount of the toner conveyed by rotating the transfer roller 5 through two revolutions or more. In addition, if the control of Experiment 5 is used and if the circumferential length C of the transfer roller 5 and the distance B are equal to each other, the image forming apparatus can be recovered from the stopped state even more efficiently. It is because the collection of the toner at the transfer roller 5 can be performed through just one revolution of the transfer roller 5, and immediately after that, the toner can be discharged to the photosensitive drum 1.

Voltage Application Timing 2

Figure 6:
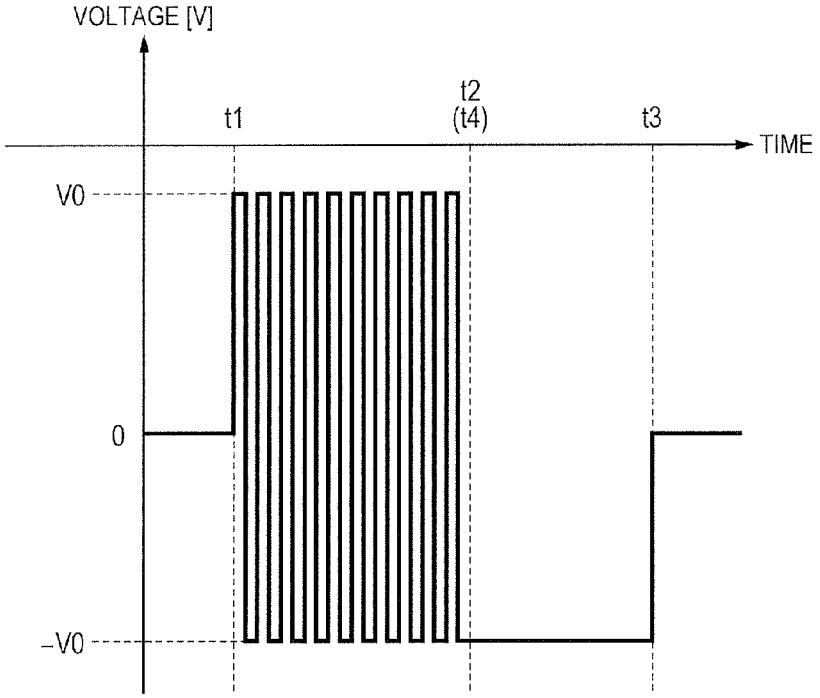
FIG. 6 is a timing chart illustrating the timing for applying the voltage to the transfer roller.

Control of the voltage applied to the transfer roller 5 in the sequence of the recovery operation will be described with reference to FIG. 6. FIG. 6 is a timing chart illustrating the timing for applying the voltage to the transfer roller 5. In FIG. 6, the horizontal axis represents time (t) and the vertical axis represents voltage (V) applied to the transfer roller 5.

The image forming apparatus according to this embodiment is configured to intermittently convey the toner, which tightly remains on the photosensitive drum 1 in the rotation direction of the photosensitive drum 1, to the cleaning blade 6*a* at the time of executing the recovery operation after an emergency stop of the image forming operation. This configuration will be described in detail below.

"t1" in FIG. 6 is a timing at which the controller unit 100 confirms that the image forming apparatus is recovered to the normal state with a paper jam or the like cleared, and at this time, the sequence of the recovery operation is started. After the sequence of the recovery operation is started, the transfer voltage V0 and the voltage −V0 having a polarity opposite to that of the transfer voltage V0 and the same magnitude as that of the transfer voltage V0 are applied to the transfer roller 5 by the bias applying unit 5*d* in an alternate manner at a predetermined cycles. As one embodiment, voltage control is performed to apply the transfer voltage V0 and the voltage −V0 to the transfer roller 5 in an alternate manner at equal intervals at a frequency of 60 Hz.

It goes without saying that simply switching the voltages in an alternate manner can achieve the effect instead of switching the voltages cyclically at equal intervals in an alternate manner because it suffices that the residual toner not be conveyed to the cleaning blade 6*a* at a time. Further, the voltage is switched at the transfer voltage V0, but the voltage V1, which is lower than the transfer voltage V0, or the like can be used instead. In this case, the voltage V1 and the voltage −V1 may be applied in an alternate manner, and the voltage V1 and the voltage −V0 may be applied in an alternate manner.

In the case where the transfer voltage V0 is applied, the toner on the photosensitive drum 1 is transferred to the transfer roller 5 at the transfer position TR illustrated in FIG. 1, and once collected on the transfer roller 5. On the other hand, in the case where the voltage −V0 is applied, the toner on the photosensitive drum 1 remains on the photosensitive drum 1 as it is without being transferred to the transfer roller 5, and is conveyed to the cleaning blade 6*a* to be removed by the cleaning blade 6*a*.

In this manner, the toner tightly remaining on the photosensitive drum 1 in the rotation direction of the photosensitive drum 1 at the time of the emergency stop is divided into a portion where the toner remains on the photosensitive drum 1 and a portion where the toner does not remain on the photosensitive drum 1, and is intermittently conveyed to the cleaning blade 6*a*. In the portion where the toner remains on the photosensitive drum 1, a pressure is applied to the cleaning blade 6*a* by the toner, while no pressure is applied to the cleaning blade 6*a* by the toner in the portion where the toner does not remain on the photosensitive drum 1.

That is, the pressure by the toner is intermittently applied to the cleaning blade 6*a*. In this manner, in a configuration in which the pressures by the toner is intermittently applied to the cleaning blade 6*a*, a tip of the cleaning blade 6*a* is released from the pressure by the toner before the tip of the cleaning blade 6*a* is caught in the rotation direction of the photosensitive drum 1. As a result, the slip-through of the toner can be reduced.

"t2" in FIG. 6 indicates a timing at which a portion of the surface of the photosensitive drum 1 which is located at the developing position DE at the time of stoppage of the image forming operation arrives at the transfer position TR. As illustrated in FIG. 6, after the timing t2, the voltage −V0 having a polarity opposite to that of the transfer voltage V0 is continuously applied to the transfer roller 5 by the bias applying unit 5*d*.

When the voltage −V0 having a polarity opposite to that of the transfer voltage V0 is continuously applied to the transfer roller 5, all the toner transferred to the transfer roller 5 is transferred again to the photosensitive drum 1 at the transfer position TR during a period from t1 to t2. The voltage V0 and the voltage −V0 are applied in an alternate manner during the period from t1 to t2, and hence the toner transferred to the transfer roller 5 also exists intermittently on the transfer roller 5. As a result, the toner transferred again to the photosensitive drum 1 exists intermittently on the photosensitive drum 1.

Therefore, in the same manner as in the period from t1 to t2, even after the timing t2 at which the voltage −V0 is continuously applied, the toner is intermittently conveyed to the cleaning blade 6*a*. Accordingly, the toner can be removed without causing slip-through of the toner at the cleaning position CL.

"t3" in FIG. 6 indicates a timing at which, after the toner on the photosensitive drum 1 is once transferred to the transfer roller 5, all the toner is completely transferred again to the photosensitive drum 1. That is, the timing t3 is a timing at which the transfer roller 5 has performed one revolution from the timing 2. However, when the amount of the toner once transferred to the transfer roller 5 is large, the timing t3 can be set to a timing at which the transfer roller 5 has performed several revolutions. The sequence of the recovery operation is ended at the timing t3 (Step S4 in FIG. 2).

Experimental Results

Experimental results on a relationship between a switching cycle of the voltage applied to the transfer roller 5 by the bias applying unit 5*d* and the slip-through of the toner will be described with reference to Table 3. This experiment was conducted as follows. Firstly, during printing of an image of a considerably high coverage rate (solid black), the image forming operation was intentionally brought to an emergency stop in the image forming operation. At this time, the toner tightly and continuously remained in the circumferential direction of the photosensitive drum 1 between the developing position DE and the transfer position TR on the surface of the photosensitive drum 1. In this state, the transfer voltage V0 and the voltage −V0 were applied to the transfer roller 5 in an alternate manner at frequencies shown in Table 3. The circumferential length between the developing position DE and the transfer position TR on the surface of the photosensitive drum 1 used in this experiment was 20 mm. For each frequency, a case where the slip-through of the toner occurred and caused a risk of an image defect is indicated by "×", a case where slight slip-through of the toner occurred but did not cause a risk of an image defect is indicated by "Δ", and a case where there was no slip-through of the toner is indicated by "○".

TABLE 3

| Frequency (Hz) | 0 (Conventional Example) | 10 | 25 | 50 |
|---|---|---|---|---|
| Length of toner continuously existing on photosensitive drum in circumferential direction (mm) | 20 | 5 | 2 | 1 |
| Occurrence of slip-through | x | Δ | ○ | ○ |

When the voltage −V0 is continuously applied to the transfer roller 5 (i.e., the frequency is 0 Hz), all the toner remaining on the photosensitive drum 1 was conveyed to the cleaning blade 6*a* without being collected by the transfer roller 5. That is, the toner of the length of 20 mm continuously existing on the photosensitive drum 1 in the circumferential direction was conveyed to the cleaning blade 6*a*. In this case, the pressure by the toner was continuously applied on the cleaning blade 6*a* with no interruption, and hence the tip of the cleaning blade 6*a* was caught in the rotation direction of the photosensitive drum 1. As a result, it was confirmed that the slip-through of the toner occurred.

When the frequency was set to 10 Hz, the length of the toner remaining and continuously existing on the photosensitive drum 1 in the circumferential direction of the photosensitive drum 1 was 5 mm. That is, the toner of the length of 5 mm in the circumferential direction was continuously conveyed to the cleaning blade 6*a*, and with an interval of 5 mm, the next toner of the length of 5 mm was conveyed. In this case, the length of the toner continuously conveyed in the circumferential direction of the photosensitive drum 1 was still long, and hence the tip of the cleaning blade 6*a* was caught due to the pressure of the toner continuously applied on the cleaning blade 6*a*. As a result, it was confirmed that the slip-through of the toner slightly occurred.

When the frequency was set to 25 Hz, the length of the toner remaining and continuously existing on the photosensitive drum 1 in the circumferential direction of the photosensitive drum 1 was 2 mm. That is, the toner of the length of 2 mm in the circumferential direction was continuously conveyed to the cleaning blade 6*a*, and with an interval of 2 mm, the next toner of the length of 2 mm was conveyed. In this case, there was no slip-through of the toner. This is because a portion of the surface of the photosensitive drum 1 on which no toner exists arrived at the cleaning blade 6*a* before the tip of the cleaning blade 6*a* was caught in the rotation direction of the photosensitive drum 1 due to the pressure by the toner so that the cleaning blade 6*a* was released from the pressure by the toner. In the same manner, when the frequency was set to 50 Hz, there was no slip-through of the toner. From these facts, it has been found that the frequency suitable for reducing the slip-through of the toner is 25 Hz or higher. Further, it is preferred that the frequency be 25 Hz or higher and 50 Hz or lower.

As described above, in this embodiment, when performing the recovery operation after the image forming operation is stopped, the toner remaining on the photosensitive drum 1 is intermittently conveyed to the cleaning blade 6*a*. Therefore, the tip of the cleaning blade 6*a* is released from the pressure of the toner before the tip of the cleaning blade 6*a* is caught in the rotation direction of the photosensitive drum 1. Accordingly, the slip-through of the toner can be reduced and the defective cleaning can be reduced. As a result, an image defect due to a defective charging caused by an adherence of the toner to the charging roller 2 can be reduced.

Another Exemplary Embodiment

So far, as illustrated in FIG. 1, the sequence of the recovery operation in a monochrome image forming apparatus has been described. In contrast to this, as another exemplary embodiment of the present invention, a sequence of a recovery operation in a full-color image forming apparatus using four colors will be described. The same components as those described above are assigned with the same reference symbols and descriptions thereof are omitted. Further, unless there is a need to particularly distinguish each color, suffixes y, m, c, and b added to the symbols to represent the respective colors are omitted in the description.

Figure 7:
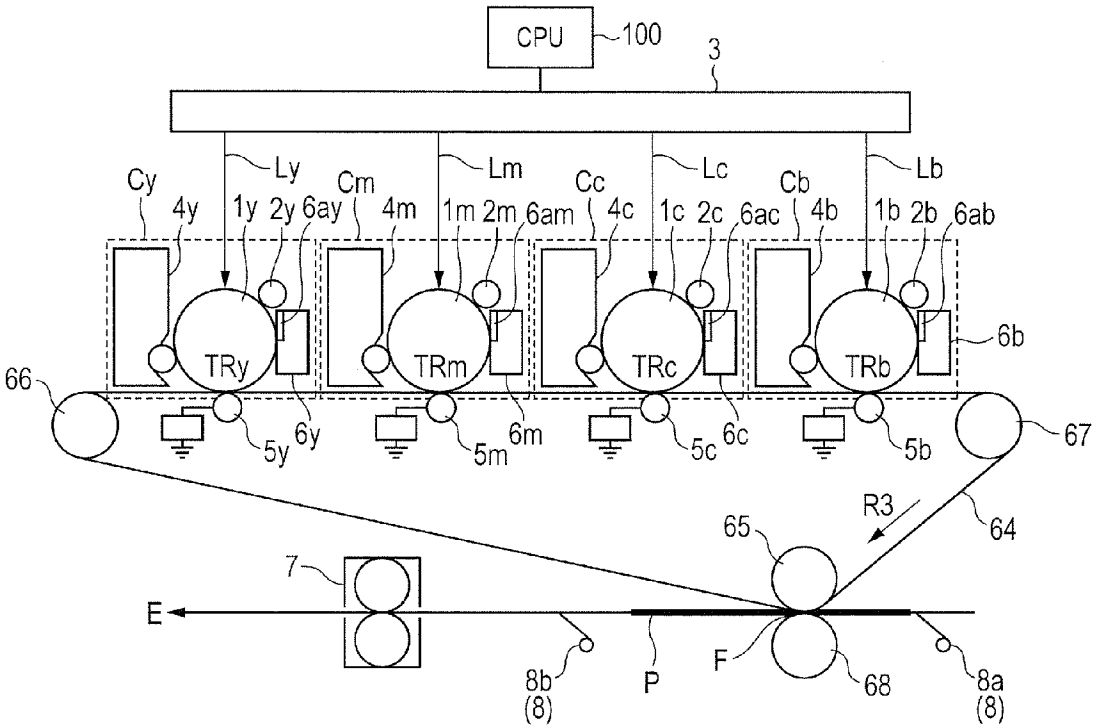
FIG. 7 is a diagram of an image forming apparatus according to another embodiment of the present invention.

A configuration of the image forming apparatus will be described first with reference to FIG. 7. FIG. 7 is a schematic cross-sectional view illustrating the configuration of the image forming apparatus according to another exemplary embodiment. The image forming apparatus is a full-color laser beam printer employing an inline-type intermediate transfer system, which is configured to form a full-color image on a recording medium P based on image information. As illustrated in FIG. 7, the image forming apparatus includes process cartridges Cy, Cm, Cc, and Cb in a removable manner, which contain therein yellow y, magenta m, cyan c, and black b toners, respectively. Each process cartridge C includes a photosensitive drum 1 as an image bearing member, a charging roller 2, a developing device 4 as a developing unit, and a cleaning device 6 integrally arranged therein. That is, multiple members including the photosensitive drum 1 are provided in the process cartridge C.

An intermediate transfer belt (intermediate transfer member) 64 as a transfer material formed of an endless belt is arranged in the image forming apparatus. As illustrated in FIG. 7, the intermediate transfer belt 64 is supported in a stretched manner around a secondary transfer roller 65 and driving rollers 66 and 67. The intermediate transfer belt 64 abuts against all the photosensitive drums 1*y* to 1*b* on its outer circumferential surface, and is a circulated (rotated) in a direction indicated by an arrow R3 illustrated in FIG. 7 (clockwise direction) at a predetermined speed.

On the inner circumferential surface of the intermediate transfer belt 64, primary transfer rollers 5*y* to 5*b* as a transfer unit are arranged to face the photosensitive drums 1*y* to 1*b*, respectively. The primary transfer rollers 5*y* to 5*b* presses against the intermediate transfer belt 64 so that the intermediate transfer belt 64 abuts against the photosensitive drums 1*y* to 1*b*. Positions on respective surfaces of the photosensitive drums 1*y* to 1*b*, which are pressed against the respective primary transfer rollers 5*y* to 5*b*, are defined as primary transfer positions TRy to TRb, respectively.

On the other hand, a secondary transfer opposed roller 68 is arranged at a position facing the secondary transfer roller 65 across the intermediate transfer belt 64. By the secondary transfer roller 65 and the secondary transfer opposed roller 68 nipping and conveying the recording medium P, a toner image formed on the intermediate transfer belt 64 (intermediate transfer member) is secondarily transferred to the recording medium P. A position on the intermediate transfer belt 64 where the secondary transfer is performed is defined as a secondary transfer position F.

The image forming apparatus further includes a registration sensor 8*a* and a sheet discharge sensor 8*b* as a stop detecting unit 8. As illustrated in FIG. 7, the registration sensor 8*a* is arranged upstream of the secondary transfer position F in a conveying direction E of the recording medium P, and the sheet discharge sensor 8*b* is arranged downstream of the secondary transfer position F in the conveying direction E and upstream of a fixing device 7 in the conveying direction E.

Image Forming Operation

An overall image forming operation of the image forming apparatus will be described with reference to FIG. 7. Firstly, in response to an image forming operation start signal, the photosensitive drums 1*y* to 1*b* are driven to rotate, and at the same time, surfaces of the photosensitive drums 1*y* to 1*b* are uniformly charged by charging rollers 2*y* to 2*b*, respectively. Subsequently, the surfaces of the photosensitive drums 1*y* to 1*b* that are uniformly charged are respectively scanned and exposed by laser beams Ly to Lb output from an exposing device 3 in response to the image information. Thus, electrostatic latent images are respectively formed on the photosensitive drums 1*y* to 1*b* based on the image information. The toners are then supplied to the photosensitive drums 1*y* to 1*b* by developing devices 4*y* to 4*b*, respectively, and hence the electrostatic latent images are developed into toner images. The toner images formed on the photosensitive drums 1*y* to 1*b* are primarily transferred to the intermediate transfer belt 64 in a sequential and superimposing manner by operations of the primary transfer rollers 5*y* to 5*b* at the primary transfer positions TRy to TRb, respectively.

Further, the recording medium P is conveyed to the secondary transfer roller 65 in synchronization with the circulating movement of the intermediate transfer belt 64, and the toner images of the respective colors that are formed on the intermediate transfer belt 64 in a superimposing manner are secondarily transferred to the recording medium P in a collective manner by an operation of the secondary transfer roller 65. The toner images transferred to the recording medium P are pressurized and heated by the fixing device 7 and fixed on the recording medium P. After that, the recording medium P on which the toner images are fixed is conveyed to the outside of the image forming apparatus, and hence a sequence of the image forming operation is completed.

Sequence of Recovery Operation

After a stop of the image forming operation is detected, the control illustrated in the flowchart of FIG. 2 is performed to put the image forming apparatus into a standby state in which the image forming operation can be resumed. Further, the control of the voltage applied to the transfer roller 5 in the sequence of the recovery operation of Step S3 illustrated in FIG. 2 can also be performed by using the voltage control described above. For example, the transfer voltage V0 and the voltage −V0 are applied to the transfer roller 5 in an alternate manner at a predetermined cycle.

Figure 8A:
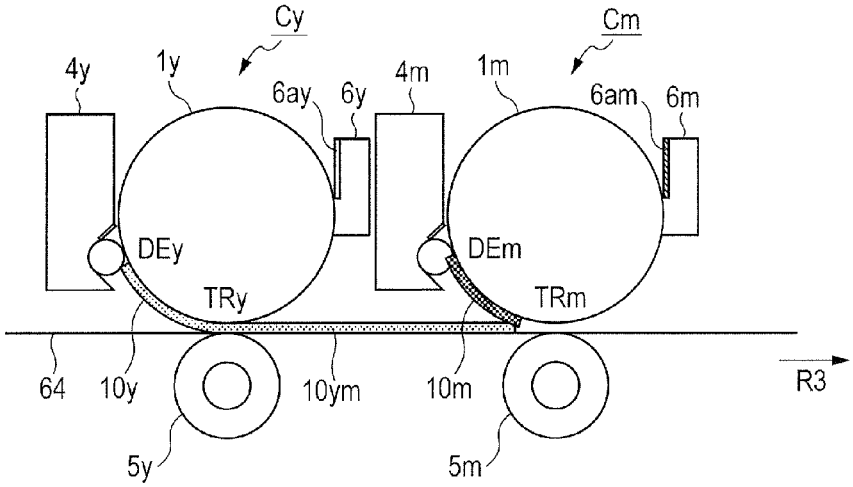
FIGS. 8A and 8B are schematic diagrams illustrating a cleaning sequence according to one embodiment of the present invention.
Figure 8B:
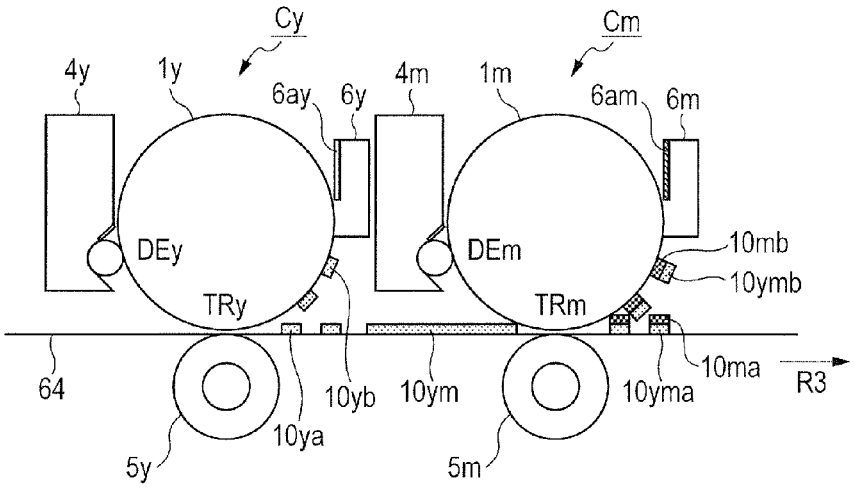

The sequence of the recovery operation in a case where the image forming operation is brought to an emergency stop so that the toner continuously exists on the intermediate transfer belt 64 in this embodiment will be described with reference to FIGS. 6, 8A, and 8B. FIGS. 8A and 8B are explanatory diagrams illustrating a conveyance of the toner in the recovery operation. FIG. 8A illustrates a state before performing the recovery operation after the stop, and FIG. 8B illustrates a state during the recovery operation. In this example, conveyance and removal of the toner remaining on the photosensitive drum 1*y* (first image bearing member), the photosensitive drum 1*m* (second image bearing member), and a portion of the intermediate transfer belt 64 between the primary transfer position TRy and the primary transfer position TRm will be described.

As illustrated in FIG. 8A, a toner 10*y* remains on the photosensitive drum 1*y* and a toner 10*m* remains on the photosensitive drum 1*m*. After it is confirmed that a trouble such as the paper jam is cleared by a user from this state (YES in Step S2 in FIG. 2), the image forming apparatus starts the sequence of the recovery operation (Step S3 in FIG. 2, the timing t1 in FIG. 6). In this embodiment as well, the transfer voltage V0 and the voltage −V0 having a polarity opposite to that of the transfer voltage V0 and the same magnitude as that of the transfer voltage V0 are applied to each of the primary transfer rollers 5*y* to 5*b* in an alternate manner at a predetermined cycle.

As a result, a toner 10*ya*, which is a part of the toner 10*y* on the photosensitive drum 1*y*, is transferred to the intermediate transfer belt 64, which is a collecting unit, at the primary transfer position TRy. Therefore, a toner 10*yb* remaining on the photosensitive drum 1*y* intermittently exists on the photosensitive drum 1*y*, and is intermittently conveyed to a cleaning blade 6*ay* as a cleaning unit. Therefore, the tip of the cleaning blade 6*ay* is released from the pressure by the toner before the tip of the cleaning blade 6*ay* is caught in the rotation direction of the photosensitive drum 1*y* due to the pressure by the toner. Accordingly, there is no slip-through of the toner at the cleaning blade 6*ay*.

On the other hand, by the circulating movement of the intermediate transfer belt 64 as the collecting unit, a toner 10*ym* remaining on the intermediate transfer belt 64 between the primary transfer position TRy and the primary transfer position TRm and the toner 10*ya* are conveyed to the primary transfer position TRm. The transfer voltage V0 and the voltage −V0 are applied to the transfer roller 5*m* in an alternate manner, and hence a toner 10*ma*, which is a part of the toner 10*m* on the photosensitive drum 1*m*, is transferred to the intermediate transfer belt 64 at the primary transfer position TRm, and the rest of toner, that is, a toner 10*mb* remains on the photosensitive drum 1*m*. At the same time, a toner 10*ymb*, which is a part of the toner 10*ym* on the intermediate transfer belt 64, is transferred to the photosensitive drum 1*m* at the primary transfer position TRm.

That is, the amount of the toner existing on the photosensitive drum 1*m* is a sum of the toner 10*mb*, which is a part of the toner 10*m* remaining on the photosensitive drum 1*m*, and the toner 10*ymb* transferred to the photosensitive drum 1*m* from the toner 10*ym* remaining on the intermediate transfer belt 64 as the collecting unit. In this manner, the amount of the toner existing on the photosensitive drum 1*m* and conveyed to a cleaning blade 6*am* is large. However, the toner exists on the photosensitive drum 1*m* intermittently, and hence the toner is intermittently conveyed to the cleaning blade 6*am* as the cleaning unit. Therefore, the tip of the cleaning blade 6*am* is released from the pressure of the toner before the tip of the cleaning blade 6*am* is caught in the rotation direction of the photosensitive drum 1*m*. Accordingly, there is no slip-through of the toner at the cleaning blade 6*am*.

The timing of ending the application of the voltages having different polarities from each other to the transfer rollers 5 in an alternate manner will be described below. In the same manner as the first embodiment, a timing at which a portion of the surface of the photosensitive drum 1*y* which is located at a developing position DEy at the time when the image forming operation is brought to the emergency stop arrives at the primary transfer position TRy is defined as t2. Further, a timing at which a portion of the surface of the intermediate transfer belt 64 which is located at the primary transfer position TRy at the time when the image forming operation is brought to the emergency stop arrives at the primary transfer position TRm located immediately downstream of the primary transfer position TRy in the circulating movement direction of the intermediate transfer belt 64 is defined as t4.

When t2>t4 is satisfied, at the timing t2, it is preferred to end the control of applying the transfer voltage V0 and the voltage −V0 in an alternate manner and perform control of applying the voltage −V0 to each transfer roller 5 in a continuous manner. The reason is as follows.

At the timing t2, all the toner 10*ym* remaining on the intermediate transfer belt 64 between the primary transfer position TRy and the primary transfer position TRm at the time of the emergency stop of the image forming operation passes through the primary transfer position TRm. That is, at the timing t2, a part of the toner 10*ym* (toner 10*ymb*) exists intermittently on the photosensitive drum 1*m*, and the other toner (toner 10*yma*) exists intermittently on the intermediate transfer belt 64.

Therefore, at the timing t2, by ending the control of applying the transfer voltage V0 and the voltage −V0 in an alternate manner and performing the control of applying the voltage −V0 to each transfer roller 5 in a continuous manner, all the toner on the intermediate transfer belt 64 can be transferred to the photosensitive drum 1. At this time, all the toner exists intermittently on the intermediate transfer belt 64 as described above, and hence all the toner transferred from the intermediate transfer belt 64 to the photosensitive drum 1 also exists intermittently.

When t2<t4 is satisfied, at the timing t4, it is preferred to end the control of applying the transfer voltage V0 and the voltage −V0 in an alternate manner and perform control of applying the voltage −V0 to each transfer roller 5 in a continuous manner. The reason is as follows.

When t2<t4 is satisfied, at the timing t2, all the toner 10*ym* remaining on the intermediate transfer belt between the primary transfer position TRy and the primary transfer position TRm at the time when the image forming operation was brought to the emergency stop does not pass through the primary transfer position TRm. That is, as illustrated in FIG. 8B, the toner 10*ym* continuously remains on the intermediate transfer belt 64. By performing the control of applying the transfer voltage V0 and the voltage −V0 in an alternate manner until the timing t4 at which all the toner 10*ym* remaining on the intermediate transfer belt 64 passes through the primary transfer position TRm, all the toner continuously remaining on the intermediate transfer belt 64 can be caused to exist intermittently.

Therefore, at the timing t4, by ending the control of applying the transfer voltage V0 and the voltage −V0 in an alternate manner and performing the control of applying the voltage −V0 to each transfer roller 5 in a continuous manner, all the toner on the intermediate transfer belt 64 can be transferred to the photosensitive drum 1. At this time, all the toner exists intermittently on the intermediate transfer belt 64 as described above, and hence all the toner transferred from the intermediate transfer belt 64 to the photosensitive drum 1 also exists intermittently.

As described above, at the time of performing the recovery operation after the stop of the image forming operation, the toners remaining on the photosensitive drum 1 and the intermediate transfer belt 64 are intermittently conveyed to the cleaning blade 6*a*. Therefore, the tip of the cleaning blade 6*a* is released from the pressure by the toner before the tip of the cleaning blade 6*a* is caught in the rotation direction of the photosensitive drum 1. Accordingly, the slip-through of the toner can be reduced and the defective cleaning can be reduced. As a result, an image defect due to a defective charging caused by an adherence of the toner to the charging roller 2 can be reduced.

Although an inline-type full-color image forming apparatus is described above, the same effect can also be obtained by using a rotary-type full-color image forming apparatus. Further, although the intermediate transfer belt is used as the collecting unit, the transfer roller as the transfer unit or a belt (ETB) configured to attract and convey a sheet of paper by using an electrostatic attraction force can also be used as the collecting unit.

As described above, in this embodiment, the toner remaining on the photosensitive drum 1 can be removed by conveying the toner to the cleaning blade 6*a* with a time delay. Therefore, a large amount of the toner is never conveyed to the cleaning blade 6*a* at a time, and hence the slip-through of the toner can be suppressed. As a result, a defective charging caused by an adherence of the toner to the charging roller 2 due to the slip-through of the toner can be suppressed, and hence an image defect caused by the defective charging can be suppressed.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-133721, filed Jun. 13, 2012, 2012-181106, Aug. 17, 2012, and 2013-118051, filed Jun. 4, 2013, which are hereby incorporated by reference herein in their entirety.

What is claimed is:

1. An image forming apparatus, comprising:

an image bearing member provided in a rotatable manner;

a developing unit configured to supply a developer of a first polarity onto the image bearing member;

a voltage applying unit configured to apply a transfer voltage;

a cleaning unit configured to remove the developer on the image bearing member; and a collecting unit, wherein when the image forming apparatus stops an image forming operation halfway, the image forming apparatus executes a recovery operation so that a part of the developer remaining on the image bearing member is (i) once transferred from the image bearing member to the collecting unit, (ii) transferred again from the collecting unit to the image bearing member, and (iii) then removed by the cleaning unit, and wherein by a first time at which rotation of the image bearing member causes a portion of the image bearing member, which contacted the developing unit when the image forming operation was stopped halfway, to reach a contact area between the image bearing member and the collecting unit in the recovery operation for the first time after stopping the image forming operation halfway, the voltage applying unit applies a voltage having a second polarity opposite to the first polarity to transfer the part of the developer of the first polarity which remains on the image bearing member to the collecting unit.

2. An image forming apparatus according to claim 1, wherein when the part of the developer is once transferred from the image bearing member to the collecting unit, the voltage applied to the collecting unit has a same polarity as a polarity of the transfer voltage, and a potential difference between the voltage applied to the collecting unit and the transfer voltage is larger than zero.

3. An image forming apparatus according to claim 1, wherein when the part of the developer is once transferred from the image bearing member to the collecting unit, a voltage having a same polarity as a polarity of the transfer voltage and a voltage having a polarity opposite to the polarity of the transfer voltage are alternately applied to the voltage applying unit.

4. An image forming apparatus according to claim 1, wherein when the part of the developer is once transferred from the image bearing member to the collecting unit, in a case where it is assumed that an amount of the developer remaining on the image bearing member without being transferred to the recording medium is 100%, an amount of the developer of 25% or more is transferred to the collecting unit.

5. An image forming apparatus according to claim 1, wherein when the part of the developer is once transferred from the image bearing member to the collecting unit, in a case where it is assumed that an amount of the developer remaining on the image bearing member without being transferred to the recording medium is 100%, an amount of the developer of 50% or more is transferred to the collecting unit.

6. An image forming apparatus according to claim 1, wherein when the part of the developer is once transferred from the image bearing member to the collecting unit and transferred again from the collecting unit to the image bearing member, the collecting unit makes two revolutions or more to transfer the developer once transferred to the collecting unit to the image bearing member.

7. An image forming apparatus according to claim 1, wherein the voltage applied to the collecting unit when the part of the developer remaining on the image bearing member is once transferred from the image bearing member to the collecting unit has a same polarity as a polarity of the transfer voltage, and the voltage applied to the collecting unit when the developer transferred to the collecting unit is transferred to the image bearing member has a polarity opposite to the polarity of the transfer voltage.

8. An image forming apparatus according to claim 1, further comprising a charging unit provided upstream of the developing unit in the rotation direction of the image bearing member and configured to charge the image bearing member in abutment with the image bearing member to adjust a surface potential of the image bearing member, wherein, when the image forming apparatus executes the recovery operation, the voltage applying unit applies the voltage to the collecting unit so that the developer once transferred to the collecting unit starts to be transferred to the image bearing member after a portion of a surface of the image bearing member, which abuts against the charging unit when the image forming operation is stopped, passes through an abutment position of the image bearing member and the collecting unit.

9. An image forming apparatus according to claim 1, wherein a circumferential length of the collecting unit is equal to a distance in a circumferential direction of the image bearing member between a position of a surface of the image bearing member, to which the developer is supplied by the developing unit, and an abutment position of the image bearing member and the collecting unit.

10. An image forming apparatus according to claim 1, wherein when the image forming apparatus executes the recovery operation, the developer is transferred to the collecting unit during a period in which a portion of a surface of the image bearing member, to which the developer is supplied by the developing unit when the image forming operation is stopped, is rotated to move away from the developing unit and then first arrives at a position at which the image bearing member comes into contact with the collecting unit.

11. An image forming apparatus, comprising:

a first image bearing member provided in a rotatable manner;

a developing unit configured to supply a developer of a first polarity onto the first image bearing member;

a voltage applying unit configured to apply a transfer voltage;

a first cleaning unit configured to remove the developer on the first image bearing member; and a collecting unit, wherein when the image forming apparatus stops an image forming operation halfway, the image forming apparatus executes a recovery operation so that a part of the developer remaining on the first image bearing member is once transferred from the first image bearing member to the collecting unit, and a part of the developer transferred to the collecting unit is transferred to a second image bearing member and then removed by a second cleaning unit, and wherein by a first time at which rotation of the first image bearing member causes a portion of the first image bearing member, which contacted the developing unit when the image forming operation was stopped halfway, to reach a contact area between the first image bearing member and the collecting unit in the recovery operation for the first time after stopping the image forming operation halfway, the voltage applying unit applies a voltage having a second polarity opposite to the first polarity to transfer the part of the developer of the first polarity which remains on the first image bearing member to the collecting unit.

12. An image forming apparatus according to claim 1, wherein the collecting unit comprises a transfer unit configured to transfer the developer by the transfer voltage applied to the transfer unit.

13. An image forming apparatus according to claim 11, wherein the collecting unit comprises a transfer unit configured to transfer the developer by the transfer voltage applied to the transfer unit.

14. An image forming apparatus, comprising:

an image bearing member provided in a rotatable manner;

a developing unit configured to supply a developer of a first polarity onto the image bearing member;

a voltage applying unit configured to apply a transfer voltage;

a cleaning unit configured to remove the developer on the image bearing member; and a collecting unit, wherein when the image forming apparatus stops an image forming operation halfway, the image forming apparatus executes a recovery operation so that a part of the developer remaining on the image bearing member is (i) once transferred from the image bearing member to the collecting unit, (ii) transferred again from the collecting unit to the image bearing member, and (iii) then removed by the cleaning unit, and wherein by a first time at which rotation of the image bearing member causes a portion of the image bearing member, which contacted the developing unit when the image forming operation was stopped halfway, to reach a contact area between the image bearing member and the collecting unit in the recovery operation for the first time after stopping the image forming operation halfway, the voltage applying unit applies a voltage having the first polarity and a potential smaller than a potential during the image forming operation to transfer the part of the developer of the first polarity which remains on the image bearing member to the collecting unit.

15. An image forming apparatus, comprising:

a first image bearing member provided in a rotatable manner;

a developing unit configured to supply a developer of a first polarity onto the first image bearing member;

a voltage applying unit configured to apply a transfer voltage;

a first cleaning unit configured to remove the developer on the first image bearing member; and a collecting unit, wherein when the image forming apparatus stops an image forming operation halfway, the image forming apparatus executes a recovery operation so that a part of the developer remaining on the first image bearing member is once transferred from the first image bearing member to the collecting unit, and a part of the developer transferred to the collecting unit is transferred to a second image bearing member and then removed by a second cleaning unit, and wherein by a first time at which rotation of the first image bearing member causes a portion of the first image bearing member, which contacted the developing unit when the image forming operation was stopped halfway, to reach a contact area between the first image bearing member and the collecting unit in the recovery operation for the first time after stopping the image forming operation halfway, the voltage applying unit applies a voltage having the first polarity and a potential smaller than a potential during the image forming operation to transfer the part of the developer of the first polarity which remains on the first image bearing member to the collecting unit.

* * * * *